US007390186B2

(12) United States Patent
Timbrook

(10) Patent No.: US 7,390,186 B2
(45) Date of Patent: Jun. 24, 2008

(54) STRUCTURAL BUILDING PANELS, APPARATUS AND METHOD FOR FABRICATING STRUCTURAL BUILDING PANELS

(76) Inventor: Robert L Timbrook, 19911 E. 300 North, Hartsville, IN (US) 47244

( * ) Notice: Subject to any disclaimer, the term of this patent is extended or adjusted under 35 U.S.C. 154(b) by 183 days.

(21) Appl. No.: 11/365,136

(22) Filed: Mar. 1, 2006

(65) Prior Publication Data

US 2007/0204557 A1 Sep. 6, 2007

(51) Int. Cl.
*B29C 43/02* (2006.01)

(52) U.S. Cl. ..... 425/501; 425/110; 425/406; 425/451.9

(58) Field of Classification Search ..... 425/501, 425/502, 63, 110, 127, 451.9, 406; 249/33, 249/34, 36, 38, 40, 45; 156/39, 346
See application file for complete search history.

(56) References Cited

U.S. PATENT DOCUMENTS 1,205,598 A * 11/1916 Sager ..... 246/465
3,472,728 A * 10/1969 Hitch ..... 428/119
3,665,662 A 5/1972 Timbrook et al.
4,140,466 A * 2/1979 Snow et al. ..... 425/110
4,374,315 A 2/1983 Timbrook
5,282,603 A * 2/1994 Taraldsson ..... 249/35
5,493,839 A 2/1996 Sax et al.
6,253,530 B1 7/2001 Price et al.

* cited by examiner

*Primary Examiner*—Robert B. Davis
(74) *Attorney, Agent, or Firm*—Baker & Daniels

(57) ABSTRACT

The present invention provides an apparatus and method for fabricating structural building panels. The apparatus may be used for fabricating panels directly on the foundation for a building. The apparatus may include a support frame, a flattening frame, a press frame, drive members such as pneumatic cylinders supported by the press frame, and posts attached to the support frame and used for aligning and coupling the apparatus and panel components. In order to fabricate a structural panel using the inventive apparatus, drywall sheets having bores sized for receiving the posts therethrough are prepared and drywall ribs or spacers are cut from drywall sheets. The support frame may be located on the foundation where the structural panel is to be positioned and a first sheet and a second sheet placed onto the posts, the sheets having adhesive and drywall spacers positioned perpendicularly therebetween. The flattening frame and the press frame may then be placed onto the posts and the press frame locked on the post to prepare for compression of the panel components. Upon actuating the pneumatic cylinders, cylinder rods press the flattening frame members against the second sheet, thereby compressing the panel components against the support frame. After the adhesive which glues the sheets and spacers together is sufficiently set up, the press components may be removed from the fabricated panel.

8 Claims, 5 Drawing Sheets

STRUCTURAL BUILDING PANELS, APPARATUS AND METHOD FOR FABRICATING STRUCTURAL BUILDING PANELS

BACKGROUND OF THE INVENTION

1. Field of the Invention

The present invention relates to building construction, and more particularly, to an apparatus for fabricating structural panels for use in building houses and other structures.

2. Description of the Prior Art

Conventional building materials used for constructing buildings often use lumber for framing walls and providing structural support and drywall for forming surfaces including walls and ceilings. Not only has the availability and quality of lumber as a natural resource declined, the cost of the lumber has also increased dramatically. In contrast, however, gypsum which is used for constructing gypsum board, or drywall, remains plentiful. Despite inflation and the increased cost of other building materials, the cost of drywall has remained substantially unchanged for over 30 years.

Unlike lumber, drywall is fireproof, dimensionally stable, and not susceptible to damage from cellulose consuming insects such as termites or powder-post beetles. The core material of drywall is abundantly available gypsum. The surface of drywall is generally paper, often recycled paper, and may also be moisture resistant.

Advantageously, drywall is very strong under compression. Structural panels, beams, or other members may be fabricated and can be used for both structural and finishing surfaces in buildings. U.S. Pat. No. 3,665,662, issued May 30, 1972, to Timbrook et al.; U.S. Pat. No. 5,493,839, issued Feb. 27, 1996, to Sax et al.; and U.S. Pat. No. 6,253,530, issued Jul. 3, 2001, to Price et al., the disclosures of which are hereby incorporated herein by reference, disclose structural building panel systems and methods relating to drywall structural panels which utilize drywall as a material.

Fabrication equipment for known structural building panel systems is generally very large so that it may entirely enclose the typical 4 foot by 8 foot drywall sheets used for structural panel fabrication. Additionally, such fabrication equipment is generally complex, costly, heavy, and not easily transportable. For example, such equipment may require vacuum and temperature control systems for expanding and setting honeycomb paper used as core material in some structural panel systems.

What is needed is a lighter-weight, easily-transportable, low-cost apparatus for the fabrication of drywall structural panels at a building site.

SUMMARY OF THE INVENTION

The present invention provides an apparatus and method for fabricating structural building panels. The apparatus may be used for fabricating panels directly on the foundation for a building. The apparatus may include a support frame, a flattening frame, a press frame, drive members such as pneumatic cylinders supported by the press frame, and posts attached to the support frame and used for aligning and coupling the apparatus and panel components.

In order to fabricate a structural panel using the inventive apparatus, drywall sheets having bores sized for receiving the posts therethrough are prepared and drywall ribs or spacers are cut from drywall sheets. The support frame may be located on the foundation at the location where the structural panel is to be positioned and a first sheet and a second sheet placed onto the posts, the sheets having adhesive and drywall spacers positioned perpendicularly therebetween. The flattening frame and the press frame may then be placed onto the posts and the press frame locked on the post to prepare for compression of the panel components. Upon actuating the pneumatic cylinders, cylinder rods press the flattening frame members against the second sheet, thereby compressing the panel components against the support frame. After the adhesive which glues the sheets and spacers together is sufficiently set up, the press components may be removed from the fabricated panel.

One form of the invention provides an apparatus for forming a structural building panel, including a support frame having at least two elongate support members, the support members supporting posts having a first and second end, each first end coupled to one of the support members, the posts extending substantially perpendicular to the support members; a press frame having at least two elongate press members having openings adapted for receiving the posts therethrough; a locking mechanism for selectively securing the press frame on the posts at a locking point located between the first and second ends; the press frame being prevented from translating on the posts toward the second end upon the locking mechanism being locked, the press frame being removable from the posts upon the locking mechanism being unlocked; and at least one drive coupled to the press members and having a drive member extendable toward the support frame, thereby pressing the structural building panel against the support members.

Another form of the invention provides a method for forming a structure for a building, including the steps of providing a support frame having posts; loading a first sheet of building material onto the posts, the first sheet having openings for receiving the posts therethrough; providing a plurality of spacers and adhesive for coupling the plurality of spacers to the first sheet on a side opposite the support frame, the plurality of spacers oriented substantially perpendicular to the first sheet; loading a second sheet of building material on the posts, the second sheet having openings for receiving the posts therethrough; providing adhesive for coupling the second sheet to the plurality of spacers; securing a press frame on the posts, the press frame having a drive member, the drive member selectively actuatable toward the first and second sheets; and actuating the drive member to compress the second sheet, plurality of spacers, and first sheet against the support frame.

Yet another form of the invention provides a method for forming a building structure on a foundation, including the steps of providing a first press on the foundation; assembling a first panel in the first press, the first panel resting on the foundation; pressing the first panel in the first press; providing a second press on the foundation adjacent the first press and first panel; assembling a second panel in the second press, the second panel resting on the foundation and coupled to the first panel; and pressing the second panel in the second press.

Advantageously, the inventive press is lightweight, easily transportable, low cost, and allows structural panels to be fabricated in place on the foundation or other installation location. Because the press provides compression which is transmitted by posts which pass through openings in the structural panel, a panel that is larger than the press itself may be fabricated. Because the structural panels may be fabricated in the final installed location, for example on a building wall foundation, no delay is experienced waiting for the adhesive of a fabricated panel to dry before proceeding with assembling fabricated panels into the desired building structure.

Advantageously, while a first building panel is being pressed and the adhesive is setting up, an adjacent panel may be assembled. While the adjacent panel is being pressed, the press for the first panel may be dismantled and used to fabricate the subsequent adjacent structural panel, thereby providing a leapfrog-like process that provides rapid fabrication of a large structure with minimal equipment and labor.

BRIEF DESCRIPTION OF THE DRAWINGS

The above mentioned and other features and objects of this invention, and the manner of attaining them, will become more apparent and the invention itself will be better understood by reference to the following description of an exemplary embodiment of the invention taken in conjunction with the accompanying drawings, wherein.

Figure 1:
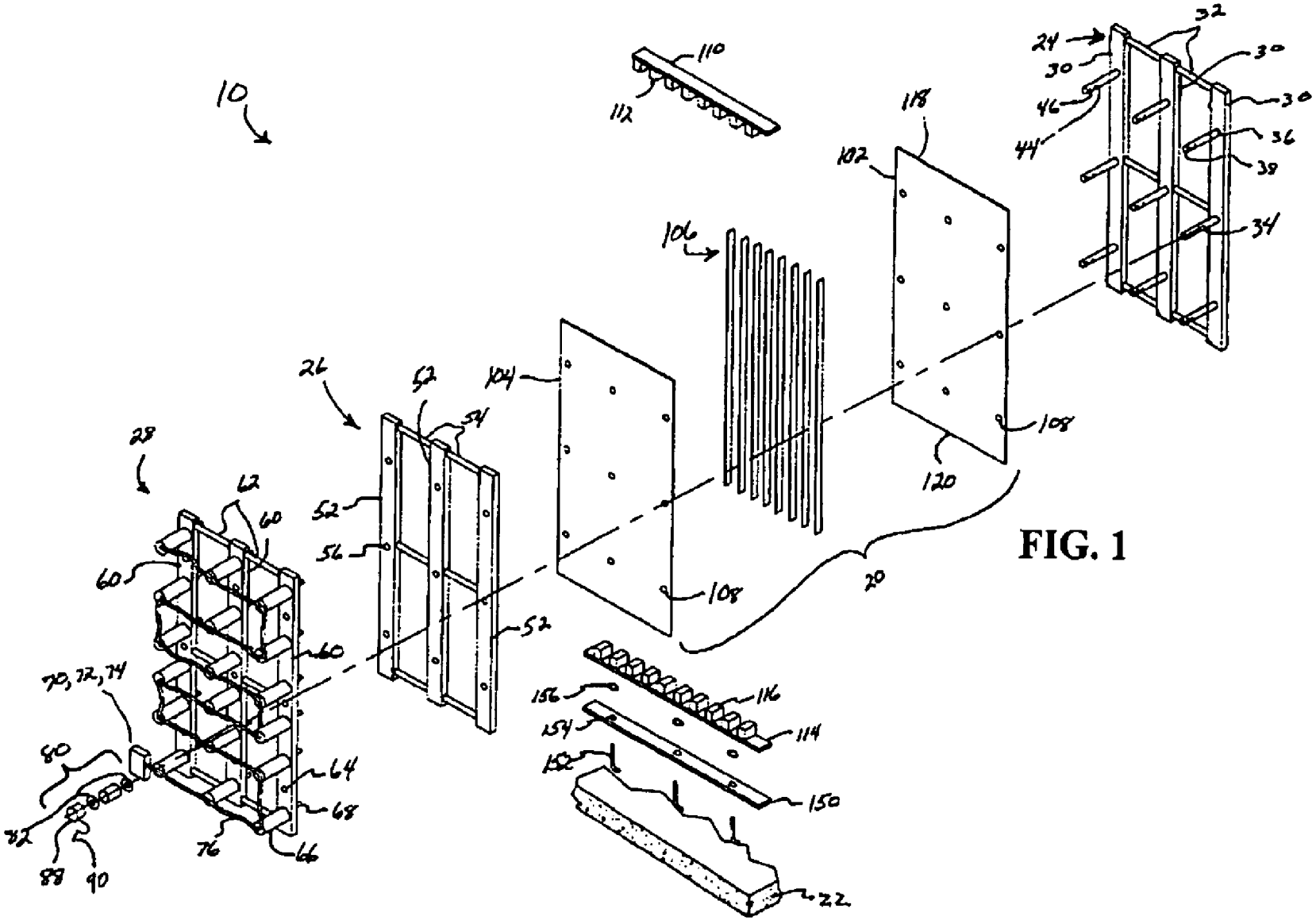
FIG. 1 is an exploded perspective view of a panel press and structural panel.

Corresponding reference characters indicate corresponding parts throughout the several views. Although the drawings represent an embodiment of the present invention, the drawings are not necessarily to scale and certain features may be exaggerated in order to better illustrate and explain the present invention. The exemplification set out herein illustrates an embodiment of the invention, in one form, and such exemplification is not to be construed as limiting the scope of the invention in any manner.

DESCRIPTION OF THE INVENTION

The embodiment disclosed below is not intended to be exhaustive or limit the invention to the precise forms disclosed in the following detailed description. Rather, the embodiment is chosen and described so that others skilled in the art may utilize its teachings.

Figure 3:
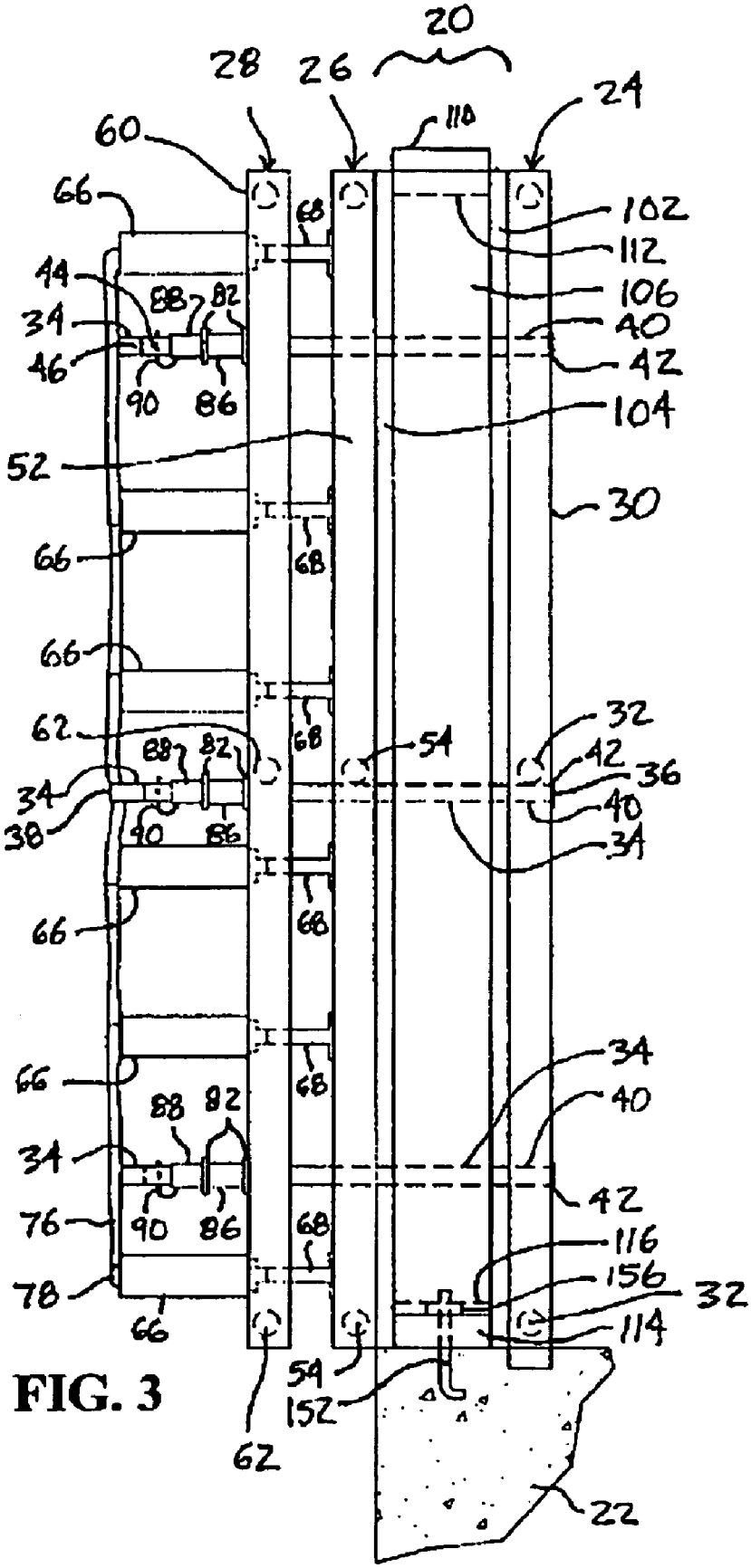
FIG. 3 is a side view of the panel press, structural panel, and foundation of FIG. 1.

Referring to FIG. 1, inventive press 10 for fabricating structural building panels 20 on building foundation 22 is shown. Press 10 includes generally support frame 24, flattening device 26, and press frame 28. Inventive press 10 is lightweight and mobile and may be easily located at foundation 22 in order to assemble and fabricate structural building panel 20 vertically and in place on foundation 22, as shown in FIG. 3.

Support frame 24 includes elongate support members 30 which may have a rectangular cross-section and which may be coupled in a substantially parallel orientation by support connecting members 32 to form a substantially planar support surface. The exemplary embodiment shown in FIGS. 1-3 and 5 includes three support members 30 which are equilaterally coupled by support connecting members 32. Support members 30 and support connecting members 32 are sized to approximately correspond with customary building panel dimensions (4 feet by 8 feet in the United States) (1 meter by 2.5 meters in Europe). However, other sizes and arrangements for support frame 24 may be utilized, provided support frame 24 provides a substantially planar surface adjacent structural building panel 20.

Support frame 24 also includes elongate posts 34 which are coupled near opposite ends and centrally on each support member 30. Referring to FIGS. 1 and 3, each post 34 includes first end 36 and second end 38. As illustrated, posts 34 are circular in cross-section. Other cross-section shapes may be utilized for posts 34. Referring to FIG. 3, first end 36 of posts 34 may extend through bore 40 through support member 30. First end 36 of posts 34 is fastened to support member 30, for example, by weld 42 between first end 36 of posts 34 and the periphery of bore 40. Posts 34 may also include first bore 44 and second bore 46 which may be located near second end 38, the purposes of which will be made apparent below.

Flattening device 26 includes elongate flattening members 52 which may have a rectangular cross-section and which may be coupled in a substantially parallel orientation by flattening connecting members 54. The exemplary embodiment shown in FIG. 1 includes three rectangular flattening members 52 that have a height approximately corresponding to the long dimension of a customary building panel and that are equilaterally coupled by flattening connecting members 54 to approximately span the short dimension of a customary building panel. However, other sizes and arrangements for flattening device 26 may be used, provided flattening device 26 provides a substantially planar surface adjacent structural building panel 20. Flattening members 52 also include bores 56 which are spaced and sized so that flattening device 26 may be coupled with support frame 24. Specifically, posts 34 are received through bores 56 and flattening device 26 may be translated toward support frame 24 with flattening device 26 and support frame 24 being substantially parallel.

Press frame 28 includes elongate press members 60 illustrated as a rectangular cross-section and which may be coupled in a substantially parallel orientation by press connecting members 62 shown as a circular cross-section. The exemplary embodiment shown in FIGS. 1-3 and 5 includes three press members 60 that have a height approximately corresponding to the long dimension of a customary building panel and that are coupled by press connecting member 62 to approximately span the short dimension of a customary building panel. However, press frame 28 may comprise other components and sizes in order to provide a substantially planar arrangement and support for press drive devices.

Figure 2:
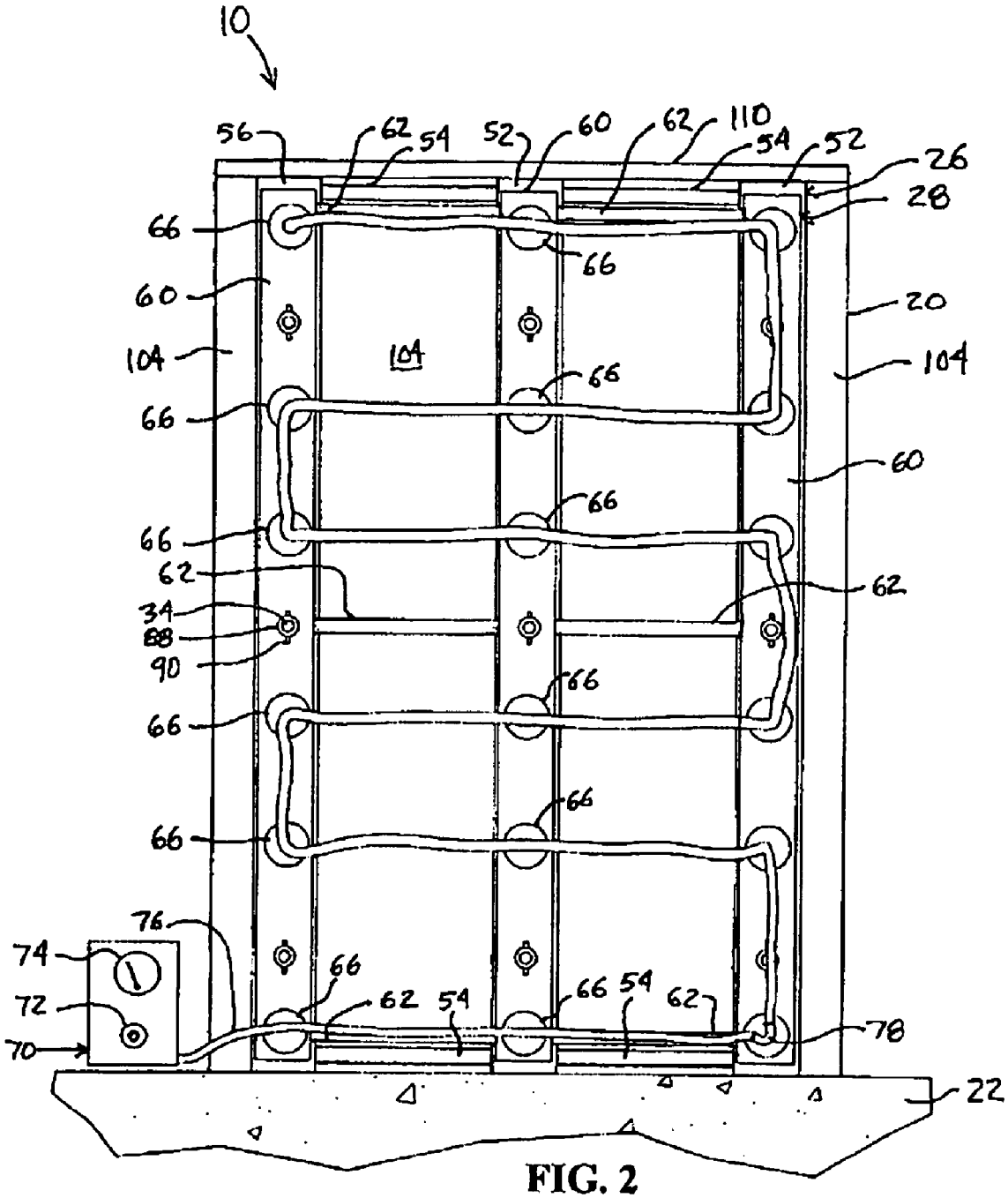
FIG. 2 is a front view of the panel press and structural panel of FIG. 1.

In the exemplary embodiment, the press drive devices comprise pneumatic cylinders 66 which are supported in approximately equidistant locations across each of press members 60. The exemplary embodiment includes 18 pneumatic cylinders 66 each having a 38 mm (1½-inch) bore and rod 68 having a stroke sufficient to consolidate sheet and spacer materials and the adhesive consolidating the same. Referring to FIG. 2, pneumatic cylinders 66 are provided actuating air from air source 70. Control of pneumatic cylinders 66 is provided by regulator 72 and pressure gauge 74 though other pneumatic controls may be alternatively used. The regulated air pressure is provided through hose 76 which is coupled to cylinders 66 by pneumatic fittings 78 such that air source 70 provides a regulated supply to all the pneumatic cylinders 66, thereby extending rods 68 from pneumatic cylinders 66. Upon adjusting regulator 72 to reduce the air pressure supplied to hose 76, pneumatic cylinders 66 are designed as double acting cylinders, or with spring retractors so that rods 68 are allowed to retract into pneumatic cylinders 66.

Although the exemplary embodiment includes 18 pneumatic cylinders 66, other drive device types and/or quantities may be utilized, for example, hydraulic cylinders, linear motors, or other actuating devices and mechanisms capable of providing a linear displacement from press frame 28.

Press members 60 also include bores 64 which are located and sized for receiving posts 34 therethrough as shown in FIG. 3. Press frame 28 is receivable onto posts 34 so that press frame 28 may be translated toward support frame 24 to a locked position, in a substantially parallel orientation, as shown in FIG. 3.

Locking mechanism 80 shown in FIGS. 1 and 3 secures press frame 28 to support frame 24 so that press frame 28 is prevented from translating along posts 34 toward second post end 38. In the exemplary embodiments, locking mechanism 80 includes washers 82, first sleeve 86, second sleeve 88, and locking pin 90. As shown in FIG. 3, first sleeve 86 may be located on posts 34 with washers 82 adjacent each end of first sleeve 86. Second sleeve 88 may be located on posts 34 adjacent the washer 88 that is closest to second end 38 of posts 34. Locking pin 90 may then be inserted in one of first bore 44 or second bore 46 through posts 34 in order to retain sleeves 86 and 88 and washers 82 on posts 34, thereby providing a force opposing the force applied to flattening device 26 by the rods 68 and preventing press frame 28 from translating toward second end 38 of posts 34. The lengths of sleeves 86 and 88 and location of bores 44, and 45 from first end 36 of post 34, may be selected in order to accommodate a specified distance between press frame 28 and support frame 24. Alternatively, other fasteners and methods of locking press frame 28 on post 34 and relative to support frame 24 may be utilized.

Press frame 28 may be alternatively mounted on posts 34, followed by flattening device 26 and locking mechanism 80. With such an arrangement cylinder rods 68 still press against flattening device 26, but force press members 60 against second sheet 104, thereby pressing the components of panel 20 against support frame 24.

The major components of press 10 may be constructed of aluminum or another lightweight metal or other rigid material. For example, connecting members 32, 54, and 62 in the exemplary embodiment are cylindrical tubular aluminum, and members 30, 52, and 60 are rectangular tubular aluminum. Lightweight materials such as aluminum facilitate handling of each component of the press by a construction worker without the need of a crane or other lifting machine.

Press 10 provides a compressive force on structural building panel 20 while the adhesive coupling components of panel 20 is setting up or drying. For example, in exemplary structural building panel 20 shown in FIGS. 1 and 3, first panel 102 and second panel 104 are glued to ribs or spacers 106 with an adhesive. Successful adhesives are polyurethanes described as 'one-part liquid, moisture cure'. Typical products in this category are marketed as UR-0218 MF by HB Fuller Co, St. Paul, Minn. USA, as Mur-Ad M-523 by Rohm and Haas Company, Philadelphia, Pa. USA. Advantages of this adhesive include room temperature curing, in most climates making use of atmospheric moisture, with limited creep. The named adhesives are neither exhaustive nor exclusive. Other adhesives of the one-part liquid, moisture cure polyurethane description may also be contemplated. The named adhesives have advantageous features such as a viscosity that permits spreading of adhesive manually as by brush or roller, or mechanically from a nozzle. Structural building panels 20 are useful as structural and finishing components of a house or other building, as described in the earlier cited patents of Price, Sax, and Timbrook.

Figure 4:
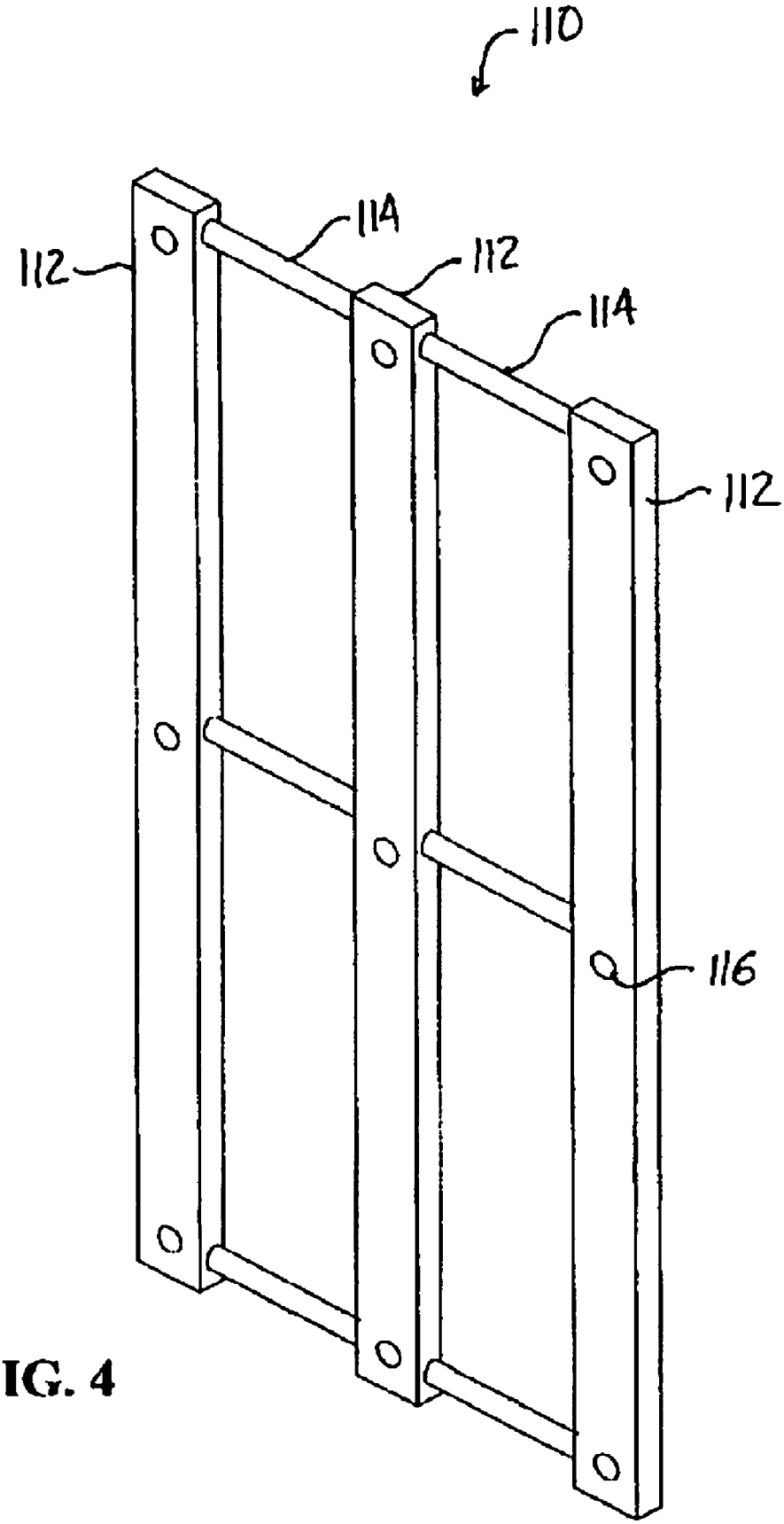
FIG. 4 is a perspective view of a boring guide according to the present invention.

In order to fabricate structural building panel 20 using inventive press 10, first panel 102 and second panel 104, for example, customary building panel sized drywall sheets having a suitable thickness dimension of 5 to 30 mm, are provided with bores 108 which are spaced and sized so that panels 102 and 104 may be received on posts 34 of support frame 24. For example, boring guide 110 shown in FIG. 4 having guide members 112 and guide connecting members 114 may be utilized. Specifically, guide bores 116 are defined in guide members 112 of boring guide 110 to provide the proper sizing and spacing for providing bores 108 in first and second panels 102 and 104. Advantageously, a number of panels 102 and 104 may be stacked and bores 108 fabricated therethrough using boring guide 110. Spacers 106 may also be fabricated from drywall and may be, for example, from 5 to 150 mm wide, thereby providing an overall structural building panel which is the width of the spacers and the thickness of combined panels 104 and 102. The exemplary embodiment has spacers, 90 mm (3½ inches) wide, providing an overall panel 20 thickness of approximately 115 mm (4½ inches) when 13 mm (½ inch) drywall is utilized. However, other drywall thicknesses and spacer widths may be utilized to provide the thickness desired for structural building panel 20. Alternatively, plywood or another building material may be substituted for some or all of the components of panel 20.

The cure time of preferred adhesives is dependent on ambient temperatures. Prepositioning of panel components facilitates assembly before the adhesive begins to cure. Noticeable curing of the adhesive begins about 10 minutes after exposure to typical air having a temperate moisture content. Elevated temperature and/or humidity may require that the assembler be more agile. Correspondingly, lower ambient humidity and/or temperature may extend the time for noticeable curing. A feature of moisture cure urethane resin is that cure can be accelerated by application of moisture, as by misting on the surfaces to which the polyurethane adhesive will be applied.

Referring to FIG. 1, after bores 108 are fabricated in first panel 102 and second panel 104, press 10 can be used to compress first panel 102 and second panel 104 against opposite edges of adhesive-covered spacers 106. Specifically, first panel 102 may be slidably received on posts 34 and against support members 30 of support frame 24. Top guide rail 110 which includes spacing guides 112 and bottom guide rail 114 which includes spacing guides 116 may be positioned at opposite top 118 and bottom ends and 120 of panels 102 and 104 so that spacers 106 may be guided to relatively parallel and equidistant locations across and between first panels 102 and 104. Second panel 104 may also be received by posts 34 and translated against substantially perpendicular spacers 106. Thereafter, flattening device 26 and press frame 28 may be slidably received by posts 34 and locking mechanisms 80 provided on each post 34 in order to retain press frame 28 relative to support frame 24.

Figure 5:
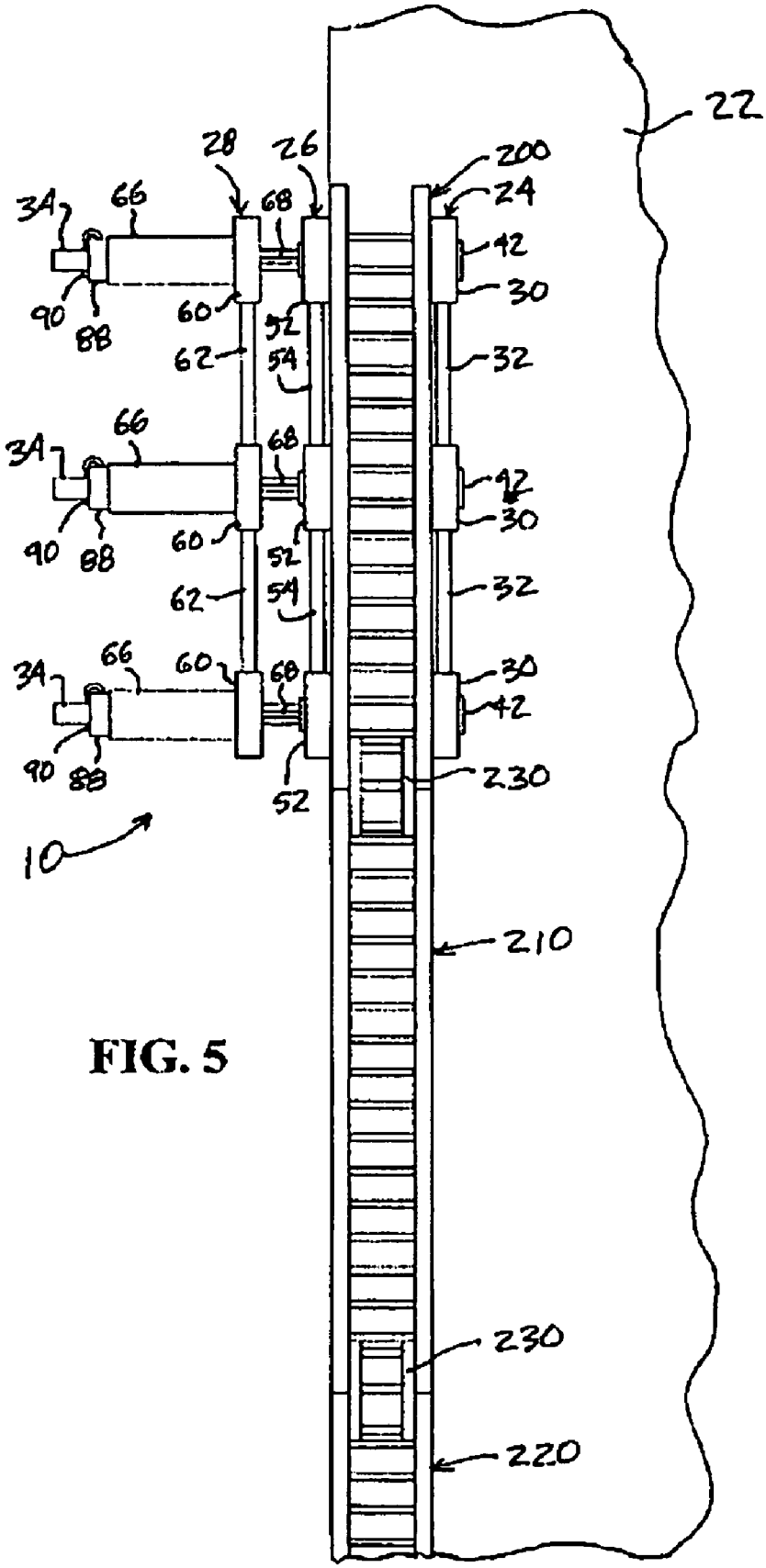
FIG. 5 is a top view of a structural wall being fabricated with a panel press and method according to the present invention.

As shown in FIG. 3, upon providing air pressure through hose 76 to cylinders 66, rod ends 130 are translated toward flattening device 26 by rods 68 translating flattening device 26 toward support frame 24 and away from press frame 28, thereby compressing second panel 104 toward spacers 106 and first panel 102. Referring to FIG. 5, inventive press 10 may be used to fabricate structural building panels directly on the foundation or other panel support structure, thus allowing the adhesive to dry while the panel is in its final position and thus eliminating any delay in handling a newly fabricated panel before the adhesive is set up or fully cured.

The applied pressure by the press 20 may be quite low. Sufficient pressure is necessary to provide and maintain contact between the surfaces having adhesive thereon for a time sufficient to effect a cure sufficient to permit handling of the panel. Complete cure can be effected after placing the panel at its location in the structure if it is removed to the structure location from the press, or sufficient to permit handling during storage awaiting placement in the building location. If the panel is assembled in the horizontal position, the applied clamping pressure may be reduced as it is aided by the weight of the drywall panel itself. For a typical drywall panel of ½ in (13 mm) thickness, the 5.4 kg/m$^2$ (1.1 lb/ft$^2$) weight of the drywall itself reduces the necessary applied force.

For the purposes of the instant invention, the drywall panel is nearly incompressible. Therefore, application of clamping force in addition to that necessary to effectively hold the surfaces having adhesive applied thereto makes no contribution to the panel. Sufficient force is necessary to bring the surfaces into contact and provide localized compression if irregularities that may be present in cut wallboard edges, where present. In addition to the weight of the drywall panels, applied force generating from 9.8 kg/m$^2$ to 49 kg/m$^2$ (2 to 10 lb/ft$^2$) has been found sufficient.

In the exemplary embodiment, 18 compression cylinders operating under 60 psi air pressure are employed. The arrangement adds 20 kg/m$^2$ (4 lb/ft$^2$) which is sufficient additional pressure to effect a good bond between the first panel 102, spacers 106, and second panel 104. Assembly of panels in the vertical position will benefit from applied force from 15 to 73 kg/m$^2$ (3 to 15 lb/ft$^2$), advantageously from 20 to 49 kg/m$^2$ (5 to 10 lb/ft$^2$).

The pressure applied may exceed these stated values and be influenced by low ambient temperatures that increase the viscosity of adhesives applied. It is expected that the practitioner will identify appropriate pressure values without undue experimentation. The pressing together of the components of structure building panel 20 provides for sound contact and bonding of the moisture-cure polyurethane adhesive between first panel 102, spacers 106, and spacers 106 and second panel 104. The exemplary adhesive set-up time for bonding the components of structural panel 20 is approximately 10 minutes. After the adhesive is sufficiently set up, the components of press 10 may be removed from panel 20. Finishing work on panel 20 may include routing of electrical wiring, filling the space between panels 102 and 104 and spacers 106 with a close cell foam insulation or other insulation, filling bores 108, and adding paint or other finishing materials to the surfaces of panels 102 and 104.

Referring to FIG. 5, press 10 may be provided on foundation 22 in the desired position of first panel 200. The components of first panel 200 may be assembled in press 20 and cylinders 66 actuated to firmly hold the components of first panel 200 together while the adhesive sets up.

Advantageously, a second press (not shown), for example identical to press 10, may be provided immediately adjacent first panel 200 and first press 10 in order to fabricate second panel 210 in its desired position on foundation 22, for example abutting first panel 200 as shown in FIG. 5. Second panel 210 may be assembled in the second press and the second press actuated to compress the components of second panel 210, all while the adhesive of first panel 200 is being set up.

In order to fabricate third panel 220, which may be located on foundation 22 abutting panel 210, first press 10 may be removed from first panel 200 and positioned at the desired location of third panel 220. Thus, while second panel 210 is being compressed by the second press, and the adhesive of second panel 210 is setting up, third panel 220 may be fabricated and cylinders 66 of first press 10 actuated to compress the members of third panel 220. This leapfrog-type construction which utilizes a minimum number of presses 10 and maximizes available labor during the initial setup and drying of the adhesive used provides for an efficient building process.

A similar fabrication process could be used with inventive press 10 to construct structural, finishing, or other surfaces and components of buildings, for example, floors and roofs. Although the above process specifies the use of two presses 20, a single press or more than two presses may be utilized as desired and in accordance with the number of available press operators.

As shown in FIG. 5, in order to couple panels 200, 210 and 220, junctions 230 which may be previously fabricated in the same fashion as panels 200, 210 and 220, may be glued in position in the interior of and overlapping adjacent panels 200, 210 and 220, thereby providing structural coupling, alignment, and support for adjacent panels 200, 210 and 220. Junctions 230 provide a tongue and groove type coupling of adjacent panels. In the exemplary embodiment, the overall dimensions of junctions 230 is 9×15×244 cm (3½ inch×6 inches×8 feet), thereby fitting firmly between opposite sides of panels 200, 210, and 220 and overlapping adjacent panels.

Referring to FIG. 1, in order to fasten panel 20 to foundation 22, sill 150 or other fastening components may be provided. In the exemplary embodiment, foundation 22 is poured of concrete with J-bolts 152 extending therefrom, as shown in FIG. 3. J-bolts 152 may be threaded at the end extending from foundation 22 so that bores 154 through sill 150 may be received therethrough and nuts 156 threaded on J-bolts 152, thus securing sill 150 against foundation 22. Sill 150 may be, for example, 2 nominal inch×4 inch lumber.

After first panel 102 and second panel 104 are positioned in press 10 on opposite sides of sill 150 as shown in FIG. 3, panels 102 and 104 may be secured to sill 150, for example by nailing or screwing through panels 102 and 104 into sill 150. As expected, bottom guide rail 114 once located on sill 150 and sandwiched by first and second panels 102 and 104 and filled with spacers 106, bottom guide rail 114 is trapped in place and may not be removed, thus, bottom guide rail 114 may advantageously be constructed of extruded polystyrene foam such as Styrofoam® brand, or another low-cost, easily-formed material. Styrofoam® is a trademark of The Dow Chemical Company. However, because top rail 110 may be removed from top end 118 of panels 102 and 104 after the spacing of spacers 106 is established, it may be desirable to construct top rail 110 of lumber or another more durable material than the foam of bottom guide rail 114.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An apparatus for forming a structural building panel, comprising:

a support frame having at least two elongate support members, said support members having posts having a first and second end, each said first end coupled to one of said support members, said posts extending substantially perpendicular to said support members;

a press frame having at least two elongate press members having openings adapted for receiving said posts therethrough;

a locking mechanism for selectively securing said press frame on said posts at a locking point located between said first and second ends, and preventing the press frame from translating on said posts toward said second end; and at least one drive coupled to said press members and having a drive member extendable toward said support frame, thereby pressing the structural building panel against said support members.

2. The apparatus of claim 1, further comprising a flattening device having openings therethrough, said openings adapted for receiving said posts therethrough, said flattening device positionable between the structural building panel and said drive member such that extending said drive member will press the panel between said flattening device and said support frame.

3. The apparatus of claim 2, wherein said locking mechanism comprises a sleeve and a fastener for locking said sleeve on said post, said sleeve sized to be received by said post and to prevent said press members from sliding toward said second end of said post, said sleeve positionable on said post between said press members and said second end of said posts.

4. The apparatus of claim 3, wherein said fastener comprises a bore defined in said post, and a locking pin, said bore substantially perpendicular to a longitudinal axis of said post, and said locking pin sized to be received by said bore.

5. The apparatus of claim 2, wherein said at least one drive comprises a pneumatic cylinder having a rod and said drive member comprises said rod.

6. The apparatus of claim 2, wherein said press frame comprises three substantially parallel elongate press members, each said press member supporting a plurality of said drives.

7. The apparatus of claim 2, wherein said support frame comprises three substantially parallel elongate support members, each support member having a plurality of said posts.

8. The apparatus of claim 7, wherein said support frame and press frame are sized to span a 4 foot by 8 foot sheet of building material.

* * * * *